US006729419B1

(12) United States Patent
Lee

(10) Patent No.: US 6,729,419 B1
(45) Date of Patent: May 4, 2004

(54) ELECTRO-MECHANICAL DRILLING JAR

(75) Inventor: Arley Gene Lee, Katy, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/580,102

(22) Filed: May 30, 2000

Related U.S. Application Data

(60) Provisional application No. 60/136,659, filed on May 28, 1999.

(51) Int. Cl.[7] ..... E21B 4/14

(52) U.S. Cl. ..... 175/297; 175/298

(58) Field of Search ..... 175/226, 297, 175/299; 166/178, 66.5

(56) References Cited

U.S. PATENT DOCUMENTS

| | | | | |
|---|---|---|---|---|
| 4,140,044 A | | 2/1979 | Biller et al. | |
| 4,291,773 A | | 9/1981 | Evans | |
| 5,085,400 A | | 2/1992 | Petersen | |
| 5,330,100 A | * | 7/1994 | Malinowski | 239/102.2 |
| 5,372,196 A | * | 12/1994 | Andersson | 175/296 |
| 5,501,425 A | | 3/1996 | Reinicke et al. | |
| 5,877,432 A | | 3/1999 | Hartman et al. | |
| 6,263,986 B1 | * | 7/2001 | Massner et al. | 175/297 |

OTHER PUBLICATIONS

Material "megamorphs" in magnetic field, Machine Design, Aug. 8, 1994 p. 18.

Leslie Langnau, Associate Editor, Actuator solutions to linear problems, Power Transmission The Magazine of Motion Systems Design, Jun. 1996, A Penton Publications, Cleveland, Ohio.

Steven Ashley, Associate Editor, Magnetostrictive actuators, Mechanical Engineering vol. 120/No. 6 Jun. 1998, p. 68.

* cited by examiner

*Primary Examiner*—William Neuder

(57) ABSTRACT

A drilling jar comprising a mandrel with a shoulder extending radially outward. The shoulder defines at least one openable and closeable orifice therethrough. An outer housing is slidably disposed about the mandrel to define an upper chamber above the shoulder and a lower chamber below the shoulder. The jar also comprises a magnetorestriction material that responds to a predetermined pressure in the upper chamber to open at least one orifice in the shoulder to allow rapid pressure communication between the upper and lower chambers.

11 Claims, 1 Drawing Sheet

SECTION-BB

SECTION-AA

SECTION-BB

ELECTRO-MECHANICAL DRILLING JAR

RELATED APPLICATIONS

This application claims the benefit of U.S. Provisional Application Ser. No. 60/136,659 filed May 28, 1999.

STATEMENT REGARDING FEDERALLY SPONSORED RESEARCH OR DEVELOPMENT

Not Applicable.

TECHNICAL FIELD OF THE INVENTION

The present invention relates to drilling jars that are connected in-line in a drill string or work over string and that are used to deliver jarring impacts during drilling or work over operations such as fishing.

BACKGROUND OF THE INVENTION

Drilling jar's and in particular Houston Engineers' Hydra-Jar® tools are used to free stuck drill strings or to recover stuck drill string components during drilling or workover operations. The jar's provide an impact blow (hence the name jar) either in the up or down directions. The driller can control the jarring direction, impact intensity and jarring times from the rig floor. The magnitude and direction of the load used to initiate the impact blow (jar) achieve this control. Examples of hydraulic jars are disclosed in U.S. Pat. Nos. 5,431,221, 5,174,393, 5,595,244, 5,447,196, 5,503,228, 5,595,253 and such patents are incorporated herein by reference.

FIG. 1 shows a cross section through detent area 11 of prior art jar 10. Upward force arrow 13 is shown applied to mandrel 12 of jar 10. This force is transmitted to outer cylindrical housing 14 by a resulting increase in pressure in the hydraulic fluid that is contained in upper chamber 16 between outer cylindrical housing 14 and mandrel 12.

The magnitude of the pressure in upper chamber 16 is directly proportional to the magnitude of the force applied to mandrel 12. This high-pressure fluid is allowed to flow through orifice 18 to a lower chamber 20. The result of this fluid flow is a relative axial movement between outer housing 14 and mandrel 12. When this relative axial movement is sufficient to place orifice 18 in juxtaposition to relief area 17 of outer housing 14 a sudden release of high pressure fluid occurs which results in a impact blow being delivered to the "knocker" part of the jar (not shown). The "knocker" is usually located at the upper most end of the Drilling Jar.

SUMMARY OF THE INVENTION

The present invention provides a drilling jar comprising a mandrel with a shoulder extending radially outward that defines at least one openable and closeable orifice therethrough. An outer housing is slidably disposed about the mandrel to define an upper chamber above the shoulder and a lower chamber below the shoulder. A magnetorestriction material responds to a predetermined pressure in the upper chamber to open the at least one orifice in the shoulder to allow rapid pressure communication between the upper and lower chambers.

DETAILED DESCRIPTION OF THE PREFERRED EMBODIMENT

Figure 1:
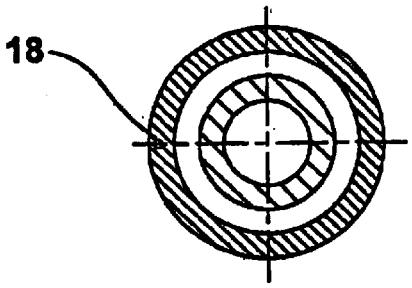
FIG. 1 is a cross-sectional view of the detent area of a prior art drilling jar.
Figure 1:
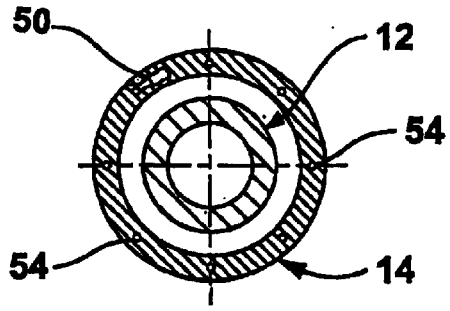
Figure 1:
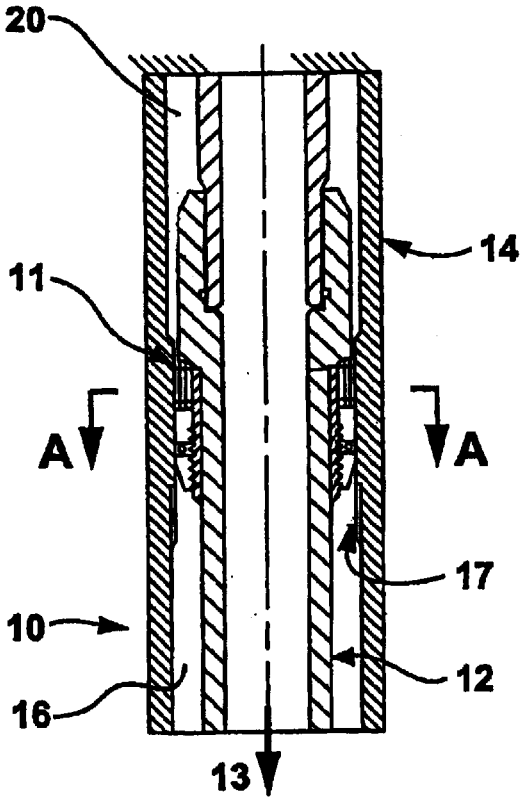
Figure 2:
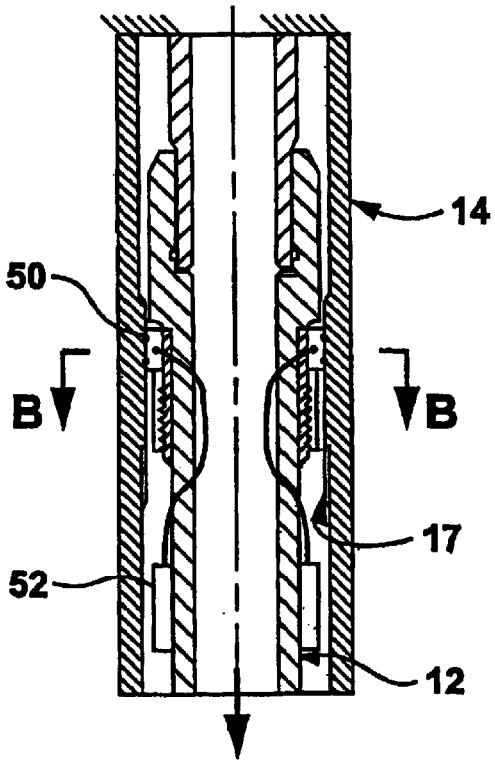
FIG. 2 is a cross-sectional view of the preferred embodiment of the detent area of the present invention for a drilling jar.

FIG. 2 shows the preferred embodiment of the detent area of the present invention for a drilling jar. The method of operation here would be the same as described above except now material 50, preferably Terfenol-D available from Etrema or alternatively a piezoelectric crystal is used to either sense the load applied or provide by its electro-mechanical nature the electrical current to in turn operate another electromechanical device 52 such as a solenoid valve or a Terfenol-D actuator. This actuator would then open orifice 54 or multiple orifices, which would provide the sudden release of the high-pressure fluid in the upper chamber with the result of an impact blow at the drilling jar's "knocker area". U.S. Pat. No. 6,037,682 discloses the use of a magnetostriction material which is the preferred material for material 50, and this patent is incorporated herein in its entirety.

One advantages of the present invention is that the delay (the time it takes for the fluid to bleed through the orifice) would not change with jar operation frequency. Current hydraulic jars experience a delay change due to heating the hydraulic fluid when it is forced through the "detent" orifice. Also, the delay could be set electronically to any value within the time delay range of the electrical circuit design. Additionally, the "detent" area of the jar could be made to use less axial length and therefore the entire tool could be made shorter.

What is claimed is:

1. A drilling jar, comprising:

(a) a mandrel with a shoulder extending radially outward, the shoulder defining at least one openable and closeable orifice therethrough;

(b) an outer housing slidably disposed about the mandrel to define an upper chamber above the shoulder and a lower chamber below the shoulder; and (c) a magnetorestriction material that responds to a predetermined pressure in the upper chamber to open the at least one orifice in the shoulder to allow rapid pressure communication between the upper and lower chambers.

2. The drilling jar of claim 1 further comprising a knocker for imparting an impact blow.

3. The drilling jar of claim 2 wherein said knocker imparts an impact blow in axially upwards direction.

4. The drilling jar of claim 2 wherein said knocker imparts an impact blow in either an axially upwards or axially downwards direction.

5. The drilling jar of claim 2 wherein said knocker imparts an impact blow in either an axially upwards or axially downwards direction.

6. The drilling jar of claim 1 wherein said magnetorestriction material controls a delay.

7. The drilling jar of claim 6 wherein the delay does not change with the drilling jar operation frequency.

8. The drilling jar of claim 6 wherein the delay is set electronically to a predetermined value.

9. The drilling jar of claim 1 wherein said mandrel defines an unobstructed bore extending through the length of the drilling jar.

10. A method of for delivering an impact blow to a component of a wellbore string, said method comprising:

running the wellbore string into a wellbore, said wellbore sting including a drilling jar having an upper chamber and a lower chamber; and applying a predetermined pressure to the upper chamber such that a magnetorestriction material responds by opening at least one orifice to allow rapid pressure communication between the upper and lower chambers of the drilling jar to deliver said impact blow.

11. The method of claim 10 further comprising:

pulling on a stuck downhole assembly with said wellbore string; and delivering said impact blow to said stuck downhole assembly without reciprocating said wellbore string.

* * * * *